US006431274B1

(12) United States Patent
Nowlin et al.

(10) Patent No.: US 6,431,274 B1
(45) Date of Patent: Aug. 13, 2002

(54) WELL PACKER

(75) Inventors: Shawn Edward Nowlin, Houston; Halit Dilber, Katy, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/602,982

(22) Filed: Jun. 23, 2000

(51) Int. Cl.[7] ..... E21B 33/127
(52) U.S. Cl. ..... 166/187; 227/334; 285/294.4
(58) Field of Search ..... 166/187; 277/331, 277/334; 29/454; 285/288.2, 294.3, 294.4, 915

(56) References Cited

U.S. PATENT DOCUMENTS

| | | | | |
|---|---|---|---|---|
| 3,529,667 A | | 9/1970 | Malone | |
| 3,837,947 A | * | 9/1974 | Malone | 156/69 |
| 4,191,383 A | | 3/1980 | Baker et al. | |
| 4,372,562 A | | 2/1983 | Carter, Jr. | |
| 4,424,861 A | | 1/1984 | Carter, Jr. et al. | |
| 5,143,154 A | | 9/1992 | Mody et al. | |
| 5,280,824 A | | 1/1994 | Eslinger et al. | |
| 5,361,479 A | | 11/1994 | Sorem | |
| 5,363,542 A | | 11/1994 | Sorem et al. | |
| 5,398,755 A | | 3/1995 | Eslinger et al. | 166/187 |
| 5,439,053 A | | 8/1995 | Eslinger et al. | |

FOREIGN PATENT DOCUMENTS

| | | |
|---|---|---|
| US | 0 599 420 A2 | 6/1994 |
| US | 0 599 423 A2 | 6/1994 |

* cited by examiner

*Primary Examiner*—William Neuder
(74) *Attorney, Agent, or Firm*—Madan, Mossman & Sriram, P.C.

(57) ABSTRACT

An inflatable packer or bridge plug utilized in well bores comprises a tubular elastomeric bladder that is circumferentially surrounded by flexible metallic rib elements. At opposite ends of the packer, the ribs are secured to the inside bore of respective end sleeves by welding and by non-welded bonding. The rib ends are corner bead welded to the end sleeve bore wall to overlie a circumferential undercut of the sleeve bore wall. A second, circumferential weld bead fuses an adjacent sleeve ring to the first and integrates peripheral elements of the ribs. One or more radial vents into the undercut facilitates distribution of a low temperature bonding compound such as epoxy or polyester resins or braze metal or solder. The welding procedures are carried to completion before the bonding agents are applied.

50 Claims, 3 Drawing Sheets

WELL PACKER

BACKGROUND OF THE INVENTION

1. Field of the Invention

The present invention relates to the art of well drilling and earth boring. More particularly, the invention relates to packer devices for closing annular space between well tubing and well casing or the borehole wall.

2. Description of Related Art

An inflatable packer is a downhole tool which can be inflated with well fluid to seal off the annular space between a well casing and a casing liner, for example. Alternatively, inflatable packers are used to seal the annulus between a tubing string and the inside wall surface of the casing, or the liner or the raw borehole wall.

The utilities for inflatable well packers are myriad. They may be used to support a column of cement above a lost circulation zone. They may also be used to isolate producing zones from cement contact. At times they are used to centralize a casing during cementing operations. Also, they may be used to isolate production zones from lost circulation zones for gravel pack operation.

Inflatable packers of the prior art typically provide structures for reinforcing and protecting the inflatable bladder. Most frequently, these structures take the form of woven or braided steel cable or a cladding of lapped steel ribs. In the case of braided cable reinforcement, a closed tube of braided material is secured at opposite ends to the packer end collars by a compression assembly between a pair of conical clamping surfaces in a manner similar to that disclosed by U.S. Pat. Nos. 4,191,383; 4,372,562; and 4,424,861. In some cases, the end attachment of braided reinforcement is supplemented by epoxy polymer that is injected into the braided cable interstices between the conical clamping surfaces.

Lapped steel ribs for packer reinforcement are secured to the respective end collars by means of a corner weld between the end-face formed by the lapped strip ends and the inside bore surface of the packer end collars. U.S. Pat. Nos. 5,143,154; 5,280,824; 5,361,479; 5,363,542; and 5,439,053 illustrate this latter type of packer reinforcement and assembly.

When the bladder element of a reinforced packer is expanded, the reinforcing element is at risk of structural failure. In the case of a lapped rib reinforcement, the usual point of failure is along the corner-weld bead.

It is an object of this invention, therefore, to strengthen the structural attachment of packer reinforcement ribs to the packer end collars.

Another object of the invention is to provide additional lines and means of lap rib attachment to packer end collars.

Also an object of the invention is the provision of structural redundancy for securing lapped rib reinforcement to a packer end collar.

A still further object of the invention is to double, in some cases, the force required to separate a lapped rib assembly from a packer end collar.

An additional object of the invention is to increase the ultimate tensile strength of the reinforcing rib assembly for an inflatable packer by distributing the load on the ribs over a larger area and thus reducing the stresses on a single weld or single line of attachment to the inflatable element sleeve.

SUMMARY OF THE INVENTION

These and other objects of the invention are accomplished by an inflatable well packer of the ribbed type in which the ribs are secured to the inside bore of the packer sleeves by a plurality of welds and by a low temperature bonding material such as an injection molded epoxy resin.

The packer ribs are assembled and held by a welding jig in the required end-weld position relative to a packer end sleeve. Preceding the end sleeve, in coaxial assembly over the jig held ribs, a cylindrical stress ring and a bonding ring are loosely positioned. The packer end sleeve is positioned over the jig confined ribs and the ribs are end-welded to the interior bore of the end sleeve. Next, the outer annulus of the bonding ring is positioned adjacent to the inner annulus of the of the end sleeve with a small separation gap therebetween. This separation gap is filled with one or more circumferential weld beads with care given to fuse the bonding ring and end sleeve material with the outer elements of the rib material An axial length segment of the bonding ring is undercut and vented with one or more radial borings to facilitate the injection and circumferential distribution of a low temperature bonding agent such as epoxy or polyester resin around the circumference of the rib assembly. Preferably, the bonding agent is injected and cured after the fusion welding is completed. The bonding agent support may be used in conjunction with the circumferential weld bead or independently thereof.

If not an integral portion of the bonding ring, a stress ring is positioned coaxially over the ribs and axially against the inner end annulus of the bonding ring. Preferably, the stress ring is secured with a crimped lip.

With both ends of the ribs secured to the end sleeves and bonding rings, one or more outer cover segments of elastomer are either calendared onto or molded about the perimeter of the rib assembly between the end sleeves. The cover segments are bandaged and the entire assembly is heat cured. If so provided, the bonding agent may be simultaneously heat cured.

After completion of the rib and cover segment assembly, the inflation bladder is inserted within the rib enclosure and secured by such means as a wedge ring.

BRIEF DESCRIPTION OF THE DRAWINGS

For a thorough understanding of the present invention, reference is made to the following detailed description of the preferred embodiments, taken in conjunction with the accompanying drawings in which like elements have been given like reference characters throughout the several figures of the drawings.

DESCRIPTION OF THE PREFERRED EMBODIMENTS

Figure 1:
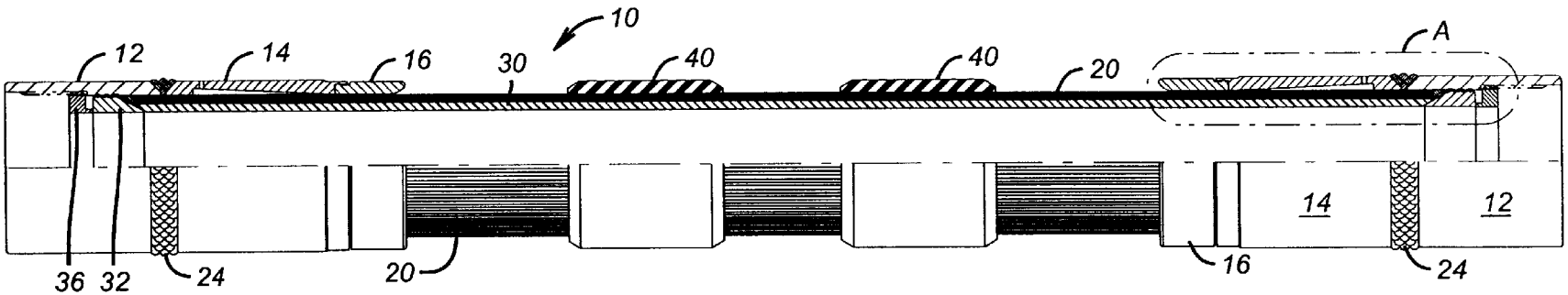
FIG. 1 is an axial length quarter section of a well packer incorporating the present invention.

Referring to drawing FIG. 1, the assembly designated generally by reference character 10 is the inflatable element of a more expansive packer assembly having similarities to that of U.S. Pat. No. 4,372,562. In particular, the inflatable element 10 concentrically overlies a cylindrical or tubular mandrel having a central, fluid carrier bore axially through the packer assembly. In particular, the inflatable element provides a fluid tight seal between the mandrel and opposite ends of the inflatable element.

Opposite ends of the inflatable element 10 comprise the axial alignment of an inner sleeve 12, and outer ring 14 and a stress ring 16. Adjacent annular ends of the inner sleeve 12 and the outer ring 14 are beveled to facilitate joinder of the ends by a circumferential weld bead 24. The opposite end of outer ring 14 is machined to provide a circumferential lip 29 that is rolled, peened or crimped into the crimp channel 25 around the outer perimeter of the stress ring 25.

Figure 2:
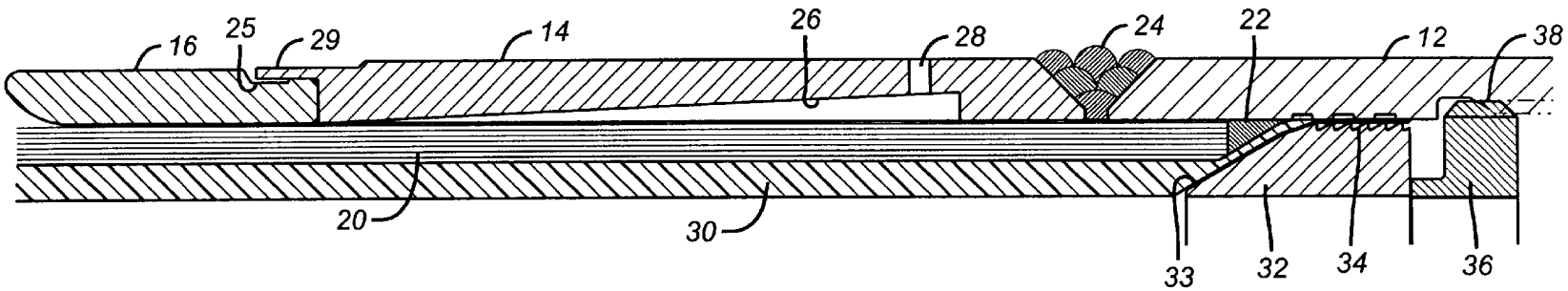
FIG. 2 is an enlargement of the FIG. 1 area designated by the perimeter of enclosure A of FIG. 1.

The internal bore wall of the outer ring 14 includes a circumferential undercut 26 as shown by FIG. 2. The undercut is ported by one or more injection apertures 28.

Secured to the internal bore of the inner sleeve 12 by means of a corner or filet weld 22 is a cylindrical assembly 20 of lapped, stainless steel ribs. The outer circumferential elements of the lapped ribs lie adjacent to the internal bore walls of the outer ring 14 as well as the stress ring 16 and thereby span across the undercut 26 in the outer ring 14 and the weld bead 24. The weld bead 24 fuses the outer perimeter elements of the ribs 20 with the end elements of the inner sleeve 12 and the outer ring 14 thereby integrating the sleeve 12 and ring 14 into a singular end sleeve unit.

A low temperature bonding agent secures the outer perimeter elements of the ribs 20 to the outer ring 14 across the undercut 26. Preferably, such a low temperature bonding agent is a polymer resin such as an epoxy or polyester compound that may be injected into the undercut 26 through the port(s) 28. However, some applications may find greater utility for a braze metal or high-strength solder. Each of these low temperature bonding agents have distinctive properties and useful applications as are well known to the art. The phrase "low temperature bonding agent" is used to distinguish the physical characteristics of a weld that fuses and mixes the base metals of a joint from those of a superficial adhesion or molecular interface bonding.

After the ribs 20 are secured to the integrated sleeve and stress ring 16, the elastomer bladder 30 is positioned within the internal rib tube and secured at respectively opposite ends by wedge rings 32. These rings 32 have a conical end face 33 and threaded serrations 34 around the outer perimeter. The wedge rings 32 are pressed into the sleeve bore to compress the tubular ends of the elastomer bladder 30 against the smoothed corner weld bead 22. A locking ring 36 is turned on threads 38 into the outer face of the wedge ring 32 to secure and maintain the compressive force on the bladder 30.

The outer perimeter of the lapped rib assembly 20 is girdled by one or more outer covers 40 of elastomer material such as natural or nitrile rubber. When the bladder 30 is expanded, these outer covers provide the contact interface to seal the packer structure to the surrounding wall.

The individual rib elements 20 are preferably fabricated of a high tensile strength steel. A stainless steel composition is a further fabrication preference. After forming, shaping and if required, heat treating, the individual rib elements are surface distressed as by sandblasting or knurling for example for the purpose of promoting a bonded interface with the low temperature bonding agent used in the undercut. The outer ring 14 may also be surface distressed at and along the sleeve undercut 26 and other locations corresponding to the low temperature bonding agent.

After the assembly preparation, the individual rib elements are brought together in an assembly jig and held at the required tubular position while the stress rings 16 and outer rings 14 are positioned loosely over the tube ends. Next, an inner sleeve 12 is positioned over the respective tube ends and the ends of the ribs are welded to the inside bore wall with a corner weld 22.

The outer ring 14 is then positioned end-to-end with the sleeve 12. Depending on many variables, a gap of about ⅛ in., for example, may be set between the adjacent ends. Between the adjacent sleeve and ring ends, a circumferential weld bead 24 is laid in one or more weld passes. The first of these passes is set fuse elements of the ribs 20 into the bead that includes the sleeve 12 and ring 14 edges.

When the welding procedures have been completed, the desired low temperature bonding agent is applied between the ribs 20 and the outer ring 14. In the case of a polymer resin such as epoxy or polyester, the compound may be injected through the injection port 28 into the under cut 26 for distribution around the rib tube 20 perimeter. The resin may be a catalyst cured or, if desired, heat cured in cooperation with the preparation of the outer covers 40.

Alternatively, the low temperature bonding agent may be braze metal or silver solder and preapplied to the undercut. After the rib assembly 20 is in place, the low temperature flow metal is heated conductively through the outer ring 14 and caused to flow between the lapped ribs. In another example, the braze or solder may be caused to flow through the aperture 28 for distribution around the rib tube.

Following placement of the low temperature bonding agent, the stress ring 16 is positioned adjacent to the inner edge of the ring 14 and under the crimp lip 29. Here, the lip 29 is either crimped, peened or rolled into the crimp channel 25 to unitize the stress ring with the sleeve.

The outer covers 40 are next fabricated by a wrapped layup of rubber or other suitable polymer or by an injection mold of such material. The rough mold or layup is then tightly wrapped (bandaged) with a binder fabric such as nylon and heat cured. The curing procedure may also include the polymer resin that was used between the ribs 20 and the outer ring 14. When the curing step is complete, the bandaging is removed and the outer covers are dimensionally sized.

At this point, the premolded bladder tube 30 is inserted through the ribbed tube 20 and the wedge ring 34 pressed into compressed position against the corner weld bead 22. Finally, the lock ring 36 is turned over internal threads 38 to secure the assembly.

Tests conducted on several permutations of the invention include those for ultimate tensile load to provide a strength comparison baseline. These tests included a tube of 80 ribs that were secured at opposite ends to respective end sleeves by corner welds between the rib ends and an internal bore of each sleeve. The sleeve material was 1030 carbon steel. The ribs were 0.015 in. thick×0.750 in. wide×16.00 in. long and of 301 stainless steel material. The rib tube layup mandrel had a 2.362 in. o.d. The average ultimate load sustained by the test examples was 64,000 pounds.

Additional test examples were fabricated in conformance with those above except that the sleeve bores were undercut and injected with epoxy resin. Rib tubes respective to the test examples were secure to the sleeves by both end welding and by epoxy bonding. The average tensile loads sustained by these examples was 110,000 pounds: an increase of 72% over the baseline configuration.

A second baseline configuration was constructed having 130 stainless steel ribs distributed around a 3.000 in. o.d. layup mandrel. The rib tube was end welded to carbon steel sleeves. The ribs were 0.020 in. thick, 1.000 in. wide and 16.00 in. long. The average ultimate load sustained by this baseline configuration was 237,500 pounds. A modification of this second baseline configuration additionally included one circumferential weld bead about the rib tube o.d. The modified test specimen sustained an average ultimate load of 332,500 pounds: an increase of 40% over the baseline configuration.

Figure 3:
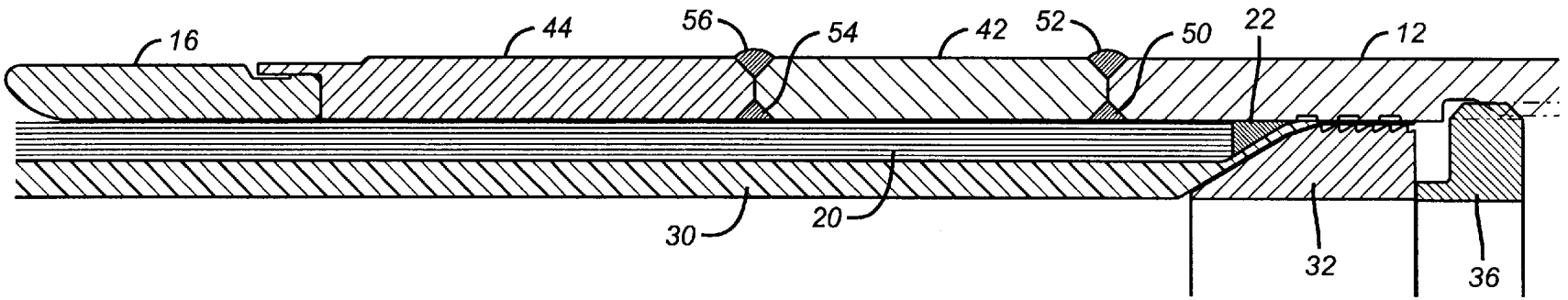
FIG. 3 is a partial section of an alternative sleeve configuration.

The FIG. 3 invention embodiment includes two supplemental sleeve rings 42 and 44 between the inner sleeve 12 and the stress ring 16. In this case, the inner sleeve 12 is corner welded to the rib tube 20 outside perimeter with a first tube O.D. bead 50. This first tube O.D. weld 50 is additional to the traditional rib end bead 22.

Thereafter, the first outer ring 42 is positioned and secure to the inner sleeve 12 with a first sleeve O.D. bead 52.

Next, the second rib tube O.D. bead 54 is applied followed by a second sleeve O.D. bead 56 that secures the second outer ring 44 to the first outer ring 42. In this example, the stress ring 16 is secured to the second outer ring 44 in a manner corresponding to that of FIG. 2. It will be understood, however, that the stress ring 16 may be secured by means of a weld bead if desired.

Figure 4:
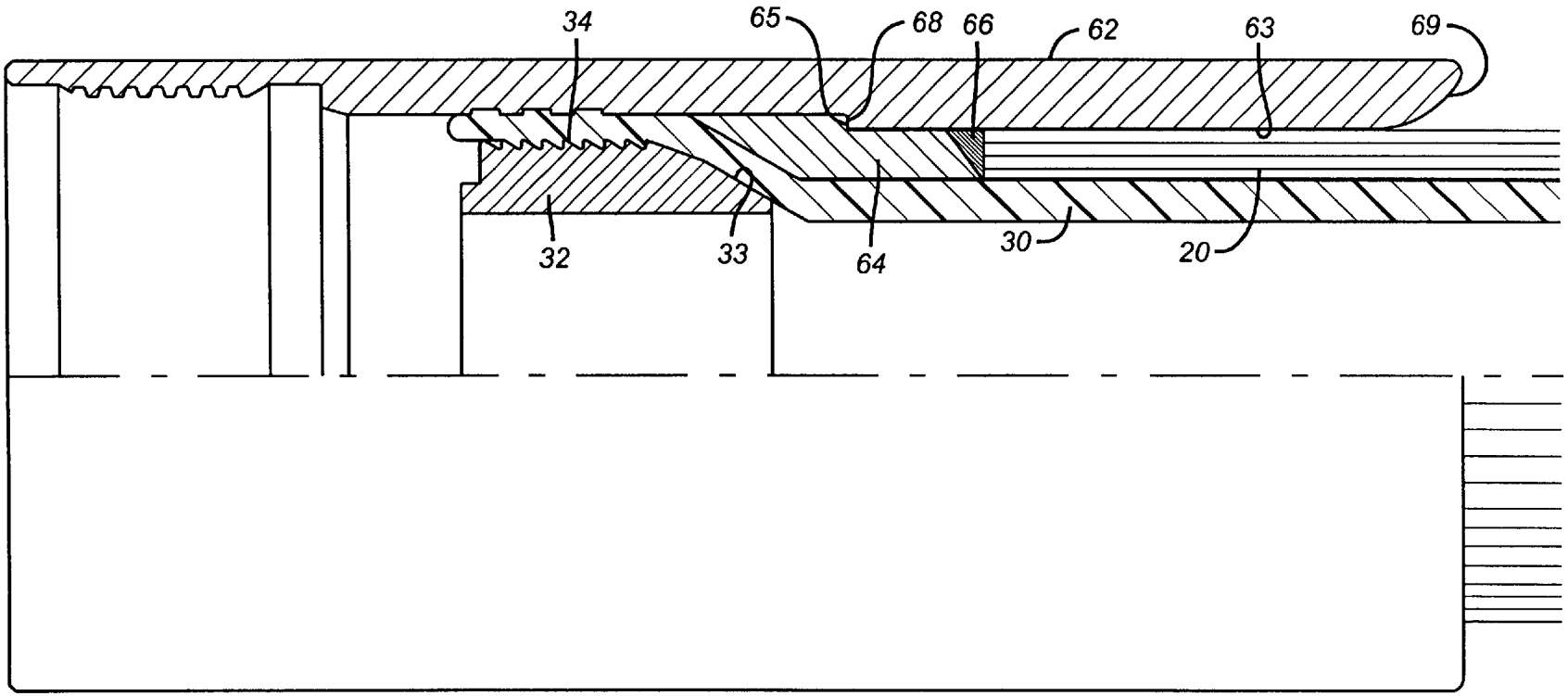
FIG. 4 is an axial length quarter section of a third embodiment of the invention.

A third embodiment of the invention, illustrated by FIG. 4, incorporates an integral or single piece sleeve 62 having a stress relieving end nose 69. This third embodiment includes no welded connection between the rib tube and the sleeve 62. Instead, the rib tube end is welded to an independent collar 64 and the sleeve and collar are coaxially engaged mechanically against respective abutment faces. The internal bore of the sleeve includes a counterbored inside step-face 68. The reinforcing rib tube 20 is end-welded with a bead 66 to the end of the rib collar piece 64. The rib collar 64 includes an outside step-face 65 that mechanically engages the inside step-face 68 of the sleeve. If desired, a low temperature bonding agent may be applied to the inside bore wall of the sleeve 62 and /or the outside perimeter of the rib tube 20 prior to coaxial assembly and induced to flow together after assembly by heat or capillary force.

Figure 5:
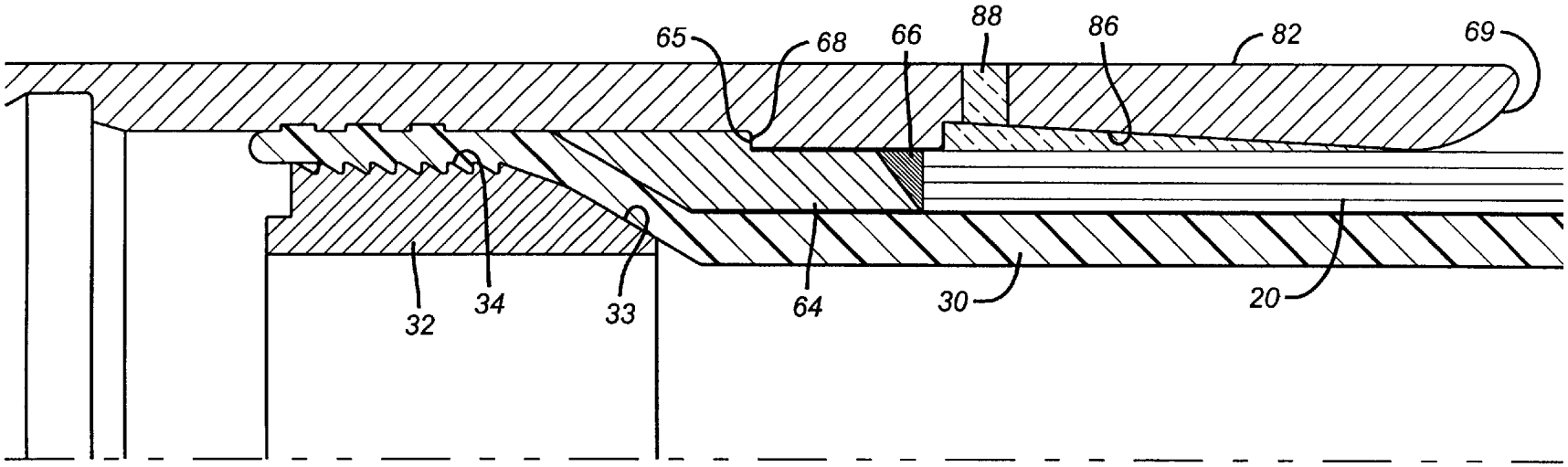
FIG. 5 is a partial section of a fourth embodiment of the invention.

The fourth invention embodiment of FIG. 5 also includes a single piece sleeve 82 in which the internal bore is undercut with a cavity 86. The cavity is ported by injection apertures 88 for insertion of a low temperature bonding agent as previously described. As with the FIG. 4 embodiment, the ribs 20 are end-welded by a bead 66 to a collar 64 that mechanically interlocks with mutual engaging step-faces 65 and 68. Following coaxial assembly, the cavity 86 is injected with epoxy resin, for example.

Although our invention has been described in terms of specified embodiments which are set forth in detail, it should be understood that this is by illustration only and that the invention is not necessarily limited thereto, since alternative embodiments and operating techniques will become apparent of those of ordinary skill in the art in view of the disclosure,. Accordingly, modifications are contemplated which can be made without departing from the spirit of the described invention

What is claimed is:

1. An inflatable packing element for use in a well bore, said inflatable packing element comprising:

(a) a substantially cylindrical first end sleeve member having an external perimeter and an internal bore wall disposed about a cylindrical axis and an annular end face disposed between said bore wall and said external perimeter;

(b) a plurality of reinforcing rib elements distributed about said bore wall substantially parallel with said axis;

(c) a first weld bead that fuses rib element ends to said bore wall by a corner bead;

(d) a second weld bead that fuses rib element edges to said annular end face; and, (e) a tubular bladder element having a tubular end thereof secured to said end sleeve internally of said rib elements.

2. An inflatable packing element as described by claim 1 having a second sleeve member corresponding to said first end sleeve member with an annular face between an external perimeter and a bore wall, the annular face of said second sleeve member disposed adjacent to the annular face of said first end sleeve and secured thereto by a third weld bead that fuses the respective external perimeters.

3. An inflatable packing element as described by claim 2 wherein said second sleeve member has a second annular end face between said external perimeter and said bore wall, said second sleeve member being secured to said rib elements by a fourth weld bead that fuses said second annular end face of said second sleeve member to said rib element edges.

4. An inflatable packing element for use in a well bore, said inflatable packing element comprising:

(a) a substantially cylindrical end sleeve having an outer axial end and an undercut bore wall;

(b) a plurality of substantially parallel ribs aligned around said bore wall to overlie the undercut of said bore wall, ends of said ribs being welded to said bore wall;

(c) a low temperature bonding material distributed about the undercut of said end sleeve between said ribs and said sleeve; and, (d) a tubular bladder element having a tubular end thereof secured to said sleeve internally of said ribs.

5. An inflatable packing element as described by claim 4 wherein said bonding material is injected into said undercut.

6. An inflatable packing element as described by claim 4 wherein said bonding material is a polymer resin.

7. An inflatable packing element as described by claim 6 wherein said polymer resin is an epoxy compound.

8. An inflatable packing element as described by claim 6 wherein said polymer resin is a polyester compound.

9. An inflatable packing element as described by claim 4 wherein said bonding material is a metal.

10. An inflatable packing element as described by claim 9 wherein said bonding material is a braze metal.

11. An inflatable packing element as described by claim 9 wherein said bonding material is a solder.

12. An inflatable packing element as described by claim 4 wherein said end sleeve is a welded assembly of first and second axially aligned tubes, said rib ends being welded to a bore wall of the first tube, said undercut being within a bore wall of the second tube and outer elements of said ribs being fused into a weld bead between said first and second tubes.

13. A method of fabricating an inflatable packing element for use in a well bore, said method comprising the steps of:

(a) positioning a plurality of rib elements around internal bore walls of an end sleeve;

(b) welding ends of said rib elements to said end sleeve bore wall;

(c) welding an axial end of said sleeve to edges of said rib elements; and, (d) securing said rib elements to said sleeve with low temperature bonding material distributed about said bore wall.

14. A method of fabricating an inflatable packing element as described by claim 13 wherein said low temperature bonding material is a polymer resin.

15. A method of fabricating an inflatable packing element as described by claim 14 wherein said low temperature bonding material is an epoxy compound.

16. A method of fabricating an inflatable packing element as described by claim 14 wherein said low temperature bonding material is a polyester compound.

17. A method of fabricating an inflatable packing element as described by claim 13 wherein said low temperature bonding material is a braze metal.

18. A method of fabricating an inflatable packing element as described by claim 13 wherein said low temperature bonding material is a solder.

19. A method of fabricating an inflatable packing element as described by claim 13 wherein said rib elements are additionally secured to said bore wall by a welded bead between said rib element ends and said low temperature bonding material.

20. A method of fabricating an inflatable packing element for use in a well bore, said method comprising the steps of:

(a) undercutting a bore wall in a packer end sleeve;

(b) positioning a plurality of rib elements around said end sleeve to overlie said undercut;

(c) welding ends of said rib elements to the bore wall of said end sleeve; and, (d) additionally securing said rib elements to said sleeve with low temperature bonding material distributed about said bore wall undercut.

21. A method of fabricating an inflatable packing element as described by claim 20 wherein said bonding material is injected into said undercut.

22. A method of fabricating an inflatable packing element as described by claim 20 wherein said bonding material is a polymer resin.

23. A method of fabricating an inflatable packing element as described by claim 20 wherein said bonding material is an epoxy resin.

24. A method of fabricating an inflatable packing element as described by claim 20 wherein a polyester resin is injected into said undercut.

25. A method of fabricating an inflatable packing element as described by claim 20 wherein said low temperature bonding material is a braze metal.

26. A method of fabricating an inflatable packing element as described by claim 20 wherein said low temperature bonding material is a solder.

27. A method of fabricating an inflatable packing element for use in a well bore, said method comprising the steps of:

(a) providing at least two sleeve members, each having an annular end and respective internal bore walls, and sleeve members being axially aligned with said annular ends adjacently positioned;

(b) positioning a plurality of rib elements around said sleeve bore walls;

(c) welding ends of said rib elements to the bore wall of a first of said sleeve members with the length of said rib elements extending through the bore of the second sleeve element; and, (d) welding together the adjacent annular ends of said first and second sleeves with a bead that fuses portions of said rib elements.

28. A method of fabricating an inflatable packer as described by claim 27 wherein the bore of said second sleeve element is undercut, said rib elements being additionally secured to said second sleeve element with low temperature bonding material distributed about said undercut.

29. A method of fabricating an inflatable packer as described by claim 27 wherein said low temperature bonding material is a polymer resin.

30. A method of fabricating an inflatable packer as described by claim 27 wherein said low temperature bonding material is an epoxy compound.

31. A method of fabricating an inflatable packer as described by claim 27 wherein said low temperature bonding material is a polyester compound.

32. A method of fabricating an inflatable packer as described by claim 27 wherein said low temperature bonding material is a braze metal.

33. A method of fabricating an inflatable packer as described by claim 27 wherein said low temperature bonding material is a solder.

34. An inflatable packing element for use in a well bore, said inflatable packing element comprising:

(a) a pair of substantially cylindrical end sleeves joined coaxially by a circumferential weld bead;

(b) a plurality of substantially parallel ribs aligned to overlie a bore wall respective to a first of said pair of end sleeves, ends of said ribs being welded to a bore wall respective to a second of said pair of sleeves and side portions of said ribs being fused to said circumferential weld bead;

(c) a low temperature bonding material distributed about the bore wall of the first end sleeve to further secure said rib to said first end sleeve; and, (d) a tubular bladder element having a tubular end thereof secured to said pair of sleeves internally of said ribs.

35. An inflatable packing element as described by claim 34 wherein said ribs overlie an undercut into the bore wall of said first end sleeve.

36. An inflatable packing element as described by claim 35 wherein said bonding material is distributed about said undercut.

37. An inflatable packing element as described by claim 36 wherein said bonding material is a polymer resin.

38. An inflatable packing element as described by claim 37 wherein said polymer resin is an epoxy compound.

39. An inflatable packing element as described by claim 37 wherein said polymer resin is a polyester compound.

40. An inflatable packing element as described by claim 34 wherein said bonding material is a braze metal.

41. An inflatable packing element as described by claim 34 wherein said bonding material is a solder.

42. An inflatable packing element as described by claim 34 wherein said bonding material is a metal.

43. An inflatable packing element for use in a well bore, said inflatable packing element comprising:

(a) at least one end sleeve having axial bore wall surfaces therethrough, said sleeve having an abutment surface projecting radially inward from said bore wall surfaces;

(b) a plurality of elongated rib elements aligned substantially parallel about a substantially circular axis;

(c) a substantially cylindrical collar having first and second axial ends and a bore wall therethrough between the collar ends, ends of said ribs beings welded to the first collar end, said collar having an abutment surface projecting radially outward whereby said collar abutment surface engages said sleeve abutment surface to limit relative coaxial displacement between said sleeve and said collar; and, (d) low temperature bonding material between said rib elements and said sleeve bore wall.

44. An inflatable packing element as described by claim 43 wherein said low temperature bonding material is a polymer resin.

45. An inflatable packing element as described by claim 44 wherein said polymer resin is an epoxy compound.

46. An inflatable packing element as described by claim 44 wherein said polymer resin is a polyester compound.

47. An inflatable packing element as described by claim 43 wherein said low temperature bonding compound is a metal.

48. An inflatable packing element as described by claim 47 wherein said metal is brazing.

49. An inflatable packing element as described by claim 47 wherein said metal is solder.

50. An inflatable packing element as described by claim 43 wherein said sleeve bore wall includes an undercut in the vicinity of said low temperature bonding material for peripheral distribution of said bonding material.

* * * * *